United States Patent [19]

Uchimoto et al.

[11] 3,946,798

[45] Mar. 30, 1976

[54] CAST PIECE GUIDE ROLL SEGMENT IN CONTINUOUS CASTING EQUIPMENT

[75] Inventors: Yoshikazu Uchimoto; Kazuo Fujimura, both of Kobe, Japan

[73] Assignee: Kobe Steel, Ltd., Kobe, Japan

[22] Filed: Apr. 10, 1974

[21] Appl. No.: 459,581

[30] Foreign Application Priority Data

| | | |
|---|---|---|
| Apr. 10, 1973 | Japan | 48-40583 |
| Apr. 12, 1973 | Japan | 48-41714 |
| Apr. 15, 1973 | Japan | 48-42864 |
| June 27, 1973 | Japan | 48-77069 |

[52] U.S. Cl. ..... 164/282; 72/237; 164/270; 226/90; 226/180

[51] Int. Cl.[2] B22D 11/12; B65H 17/20; G03B 1/54

[58] Field of Search ..... 164/282, 270, 277; 72/237, 72/238, 239, 234, 235; 226/90, 180; 308/24

[56] References Cited

UNITED STATES PATENTS

| | | | |
|---|---|---|---|
| 2,734,406 | 2/1956 | O'Malley | 72/239 |
| 3,001,424 | 9/1961 | Pickles | 72/237 |
| 3,309,909 | 3/1967 | Wilson | 72/237 |
| 3,328,973 | 7/1967 | Scheib | 72/239 |
| 3,757,848 | 9/1973 | Scholz et al. | 164/270 X |

*Primary Examiner*—R. J. Shore
*Assistant Examiner*—John S. Brown
*Attorney, Agent, or Firm*—Oblon, Fisher, Spivak, McClelland & Maier

[57] ABSTRACT

A cast piece guide roll segment in continuous casting equipment having a curved cast piece guide path which is used in the structure for supporting the roll groups in the respective curved portions for guiding the cast piece leaving the mold along the curve between the vertical and horizontal paths. In view of the problems inherent in continuous casting equipment such as the need for frequent roll changes and emergency shut-downs, the roll segment disclosed includes roll units having at least a pair of rolls and bearings provided at opposite ends thereof and removable from a frame, on which frame are mounted pivotable caps for holding roll units.

4 Claims, 6 Drawing Figures

CAST PIECE GUIDE ROLL SEGMENT IN CONTINUOUS CASTING EQUIPMENT

BACKGROUND OF THE INVENTION

1.Field of the Invention:

The present invention relates generally to continuous casting equipment and more particularly to a cast piece guide roll segment in continuous casting equipment.

2. Description of the Prior Art:

Curved-type continuous casting equipment includes a mold having a curved inner wall, a secondary cooling zone having a curved guide path including therein a plurality of rolls arranged along any suitable curved portion, such as an arc, parabola, hyperbola or the like, for guiding the cast piece leaving the mold from the vertical position to the horizontal position, pinch rolls disposed subsequently to the secondary cooling zone for continuously drawing the cast piece, and a cutter for cutting the cast piece drawn by the pinch rolls into any desired size. For the roll groups of the secondary cooling zone, in such curved-type continuous casting equipment, it is necessary to replace the rolls due to wear of the rolls in this zone caused by constant contact thereof with the cast piece, due to damage of the rolls caused by a thermal effect from the cast piece, or due to the requirement for changing the cast piece size. In view of the feasibility of roll replacement, it is practiced that the roll groups in the secondary cooling zone are separated into cast piece guide roll segments having a plurality of roll pairs as a unit. Since each of the rolls in the cast piece guide roll segment is subjected to hydrostatic pressure due to unsolidified molten steel remaining in the interior of the cast piece, thereby producing the bulging of the solidified shell of the cast piece, sufficient mechanical strength to prevent such bulging is required. Particularly, with the recent tendency to enlarge the cast piece size, the construction itself of the cast piece guide roll segment is correspondingly enlarged and increased in weight, resulting in difficulty in the replacement operation of the cast piece guide roll segment. Particularly, the cast piece guide roll segment in the portion comprising the curved guide path is disposed in a curved and inclined condition, and therefore, it must be removed in the radial direction of the curved path or in the direction transverse to the guide path, thereby rendering the replacement of the cast piece guide roll segment extremely difficult. It is therefore very difficult to accomplish a smooth replacing operation of the cast piece guide roll segment. As a result, the cast piece guide roll segment requires a long time for replacement, and the shut-down time of the equipment is necessarily increased, that is, the high productivity inherent in such equipment is hindered.

In such continuous casting equipment, it is also known that a failure in the form of a rupture occurs when the solidified shell of the cast piece leaving the mold is broken and unsolidified molten steel in the interior flows out. The generation of this rupture causes interruption of the operation of the equipment, such that the cast piece is allowed to remain in the cast piece guide roll segment of the secondary cooling zone. As the cast piece remaining in the cast piece guide roll segment cools, it contracts and curves inwardly to a greater extent that the curved cast steel guide path as the cooling progresses. Therefore, the cast piece itself acts as a large spring. This contraction and curving of the cast piece exerts an undue force of deformation on the rolls of the secondary cooling zone supporting the cast piece, that is, on each roll of the cast piece guide roll segment, and the cast piece guide roll segment breaks under the force of deformation. Particularly, such tendency is extensive in the curved-type continuous casting equipment wherein the secondary cooling zone is in the form of any of the continuous curves as described above. Therefore, it has been considered necessary to protect the cast piece guide roll segment during generation of the rupture as an inherent problem in such continuous casting equipment.

SUMMARY OF THE INVENTION

Accordingly, it is an object of the present invention to provide a novel cast piece guide roll segment, which permits rapid replacement of the roll groups in the secondary cooling zone necessitated by wear and damage to the rolls or change of the cast piece size, and thereby minimizes the shut-down time of the equipment, allowing the high productivity to be maintained.

It is another object of the invention to provide a novel cast piece guide roll segment which protects the roll groups in the secondary cooling zone from undue force of deformation exerted on them by contraction and curving due to natural cooling of the cast piece during generation of a rupture.

The foregoing objects of the invention can be accomplished by inserting roll units by rotatably mounting rolls of the cast piece guide roll segment into a frame having an upwardly opening aperture, and by fixing the roll units by means of caps pivotably mounted on the frame.

More particularly, roll units which rotatably support at least a pair of rolls with the interval of opposing rolls unfixed are to be removable from a frame receiving them, and the frame is provided with an aperture at the top for removal and insertion of the roll units and with caps pivotable to close the aperture, and a drive mechanism for the caps is provided which is capable of transmitting force acting on the rolls to the frame through the caps even when the caps are stopped at any pivoting position thereof. The cast piece guide roll segment according to the present invention permits easy replacement and prevents damage during generation of a rupture.

BRIEF DESCRIPTION OF THE DRAWINGS

Various other objects, features and attendant advantages of the present invention will be more fully appreciated as the same becomes better understood from the following detailed description when considered with the accompanying drawings, wherein like reference characters designate corresponding parts throughout the several views and in which.

DETAILED DESCRIPTION OF THE PREFERRED EMBODIMENTS

Figure 1:
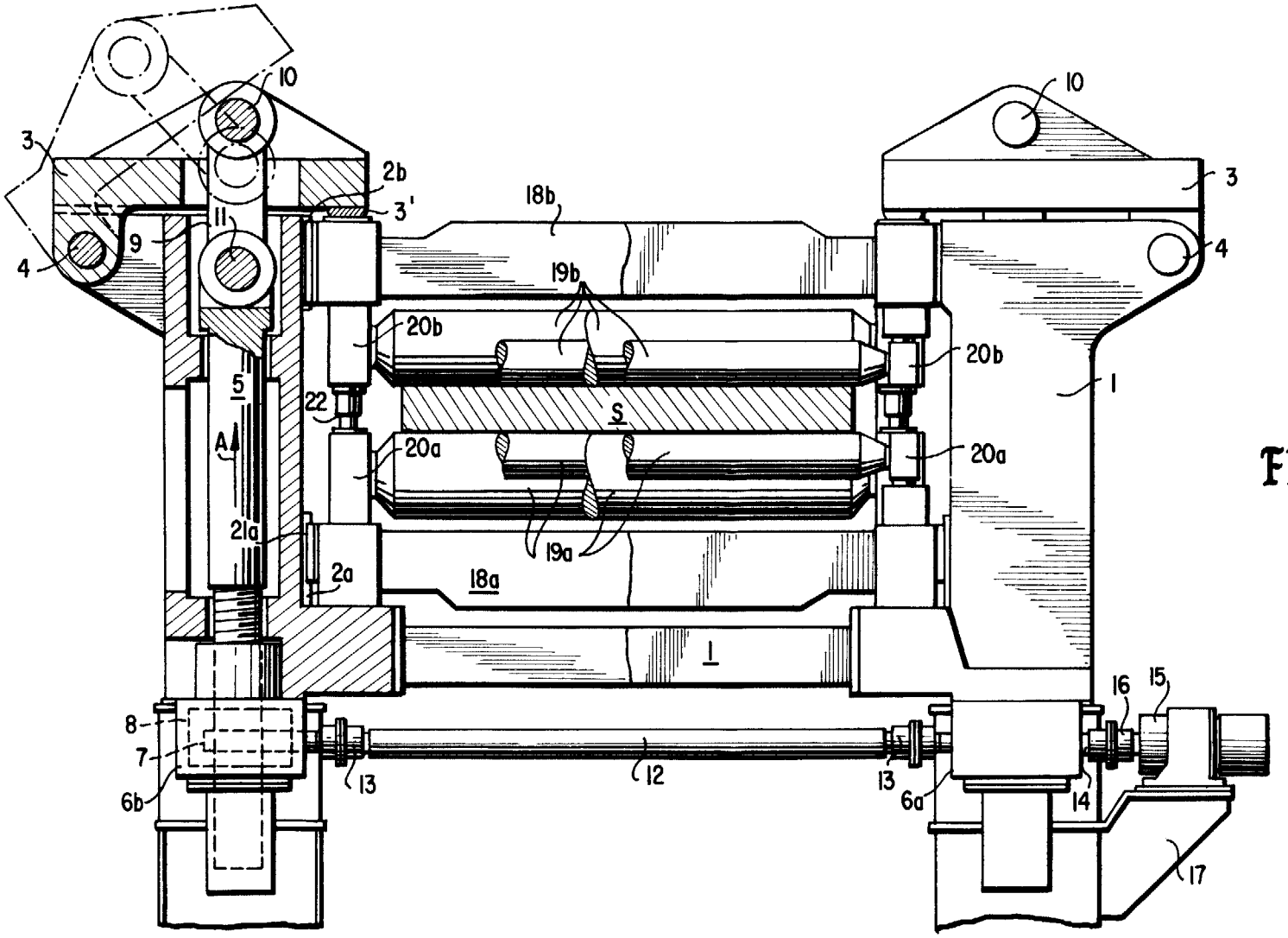
FIG. 1 is a front view, partly in cross-section, of an embodiment of the present invention.

The cast piece guide roll segment, according to the present invention will now be described in detail with particular reference to a first embodiment shown in FIGS. 1 and 3.

A frame 1 of a cast piece guide roll segment having an upwardly opening aperture which frame is provided in its inner surface with grooves 2*a*, 2*b* for insertion of roll units 18*a*, 18*b* to be described. Caps 3 are pivotally mounted through pins 4 on the top of the frame 1. Caps 3 are respectively connected by pins 10 and 11 and through connecting rods 9 to screw shafts 5. Shafts 5 mate with worm wheels 8 in worm reduction gears 6*a* and 6*b* which are in turn fixed to the bottom of the frame 1. The worm reduction gears contain worms 7 and the worm wheels 8. The worm reduction gears 6*a* and 6*b* are synchronously rotated through couplings 13 by a transmission shaft 12, while a worm shaft 14 of the worm reduction gear 6*a* is connected through a coupling 16 to a suitable drive source, for example, an electric motor 15 mounted on a support 17 fixed to the frame. The lower roll unit 18*a* rotatably mounts through bearings 20*a* a group of rolls 19a for contacting and supporting a cast piece S. Lower roll unit 18a is mounted in the frame 1 by a projection 21*a* formed on the side of the roll unit 18*a* which is inserted into the groove 2*a* of the frame 1. The upper roll unit 18*b* rotatably mounts through bearings 20*b* a group of rolls 19*b* on the frame 1 above the lower roll unit 18*a* through a spacing retaining member 22. The upper roll unit is mounted in the frame 1 by a projection 2/*b* formed on the side of the upper roll unit 18*b* which is inserted into the groove 2*b*. Caps 3 fix a pair of the lower and upper roll units 18a and 18*b* in the frame 1. In the FIG., the numeral 3′ is a crossarm brace secured to the cap 3.

In the cast piece guide roll segment constructed as described above, the condition shown is that during operation, and the replacement of the roll due to a size change of the cast piece, or damage or wear of any roll in the roll groups will now be described. When the electric motor 15 mounted on the support 17 is actuated, the rotation of the electric motor 15 rotates through the coupling 15 the worm 7 in the worm reduction gear 6*a*. Rotation of this worm 7 is simultaneously transmitted through the transmission shaft 12 to the worm 7 in the worm reduction gear 6*b*, such that the worm wheels 8 meshing with the worms 7 are rotated. The screw shafts 5 are thereby moved axially upwardly (in the direction of arrow A in FIG. 1) since they are threadably engaged with the worm wheels 8. The caps 3 connected by pins 10 and 11 through the connecting rods 9 to the screw shafts 5 pivot about the pins 4 (the condition shown in phantom line in FIG. 1), such that the roll units 18*a*, 18*b* inserted in the frame 1 are released from restraint. After releasing the roll units 18*a*, 18*b* from constraint, they are removed by any suitable means such as an overhead travelling crane. However, since the roll units 18*a*, 18*b* are constructed by merely mounting the roll groups 19*a*, 19*b* by means of bearings, they are generally reduced in weight as compared to the conventional cast piece guide roll segment, and therefore, they can be quite easily removed. After the removal of the roll units 18*a*, 18*b*, new roll units 18*a*, 18*b* prepared on an off-line are introduced, which operation is performed in the reversed procedure to the operation described above. That is, the roll units 18*a*, 18*b* are transported above the frame by any suitable transporting means, and the lower roll unit 18*a* is first gradually inserted in the frame 1, with the projection 21*a* provided on the side of the roll unit 18*a* being fitted in the groove 2*a* in the inner side surface of the frame 1, to thereby dispose the lower roll unit 18*a* in place.

The upper roll unit 18*b* is then inserted in the frame 1 in the same manner as the lower roll unit 18*a*, such that the upper roll unit 18*b* will rest on the spacing retaining member 22 provided on the lower roll unit 18*a* previously inserted in the frame 1. The spacing between the roll groups 19*a* and 19*b* in the lower and upper roll units 18*a*, 18*b* is thereby retained at a predetermined cast piece size. When the electric motor 15 is then rotated in the opposite direction to that described above, the screw shafts 5 are lowered through the worm reduction gears 6*a*, 6*b* and thus the caps 3 secure the roll units 18*a*, 18*b* to the frame 1.

When utilizing the cast piece guide roll segment according to the present invention, if a rupture is generated in the casting process, an undue force of deformation is exerted on the upper roll unit due to contraction and curving accompanying cooling of the cast piece. In this event, if the electric motor 15 is actuated to raise the screw shafts 5 and release the roll units 18*a*, 18*b* from restraint, the upper roll unit 18*b* floats in the frame 1 to thereby absorb the undue force of deformation, and damage to the roll groups 19*a*, 19*b*, particularly to the roll group 19*b* can be avoided.

Figure 2:
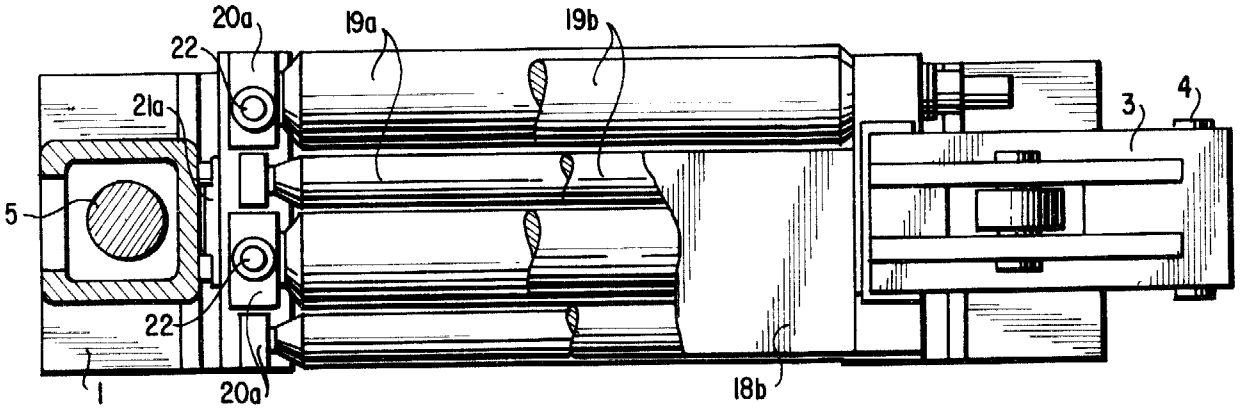
FIG. 2 is a plan view, partly in cross-section of FIG. 1.
Figure 6:
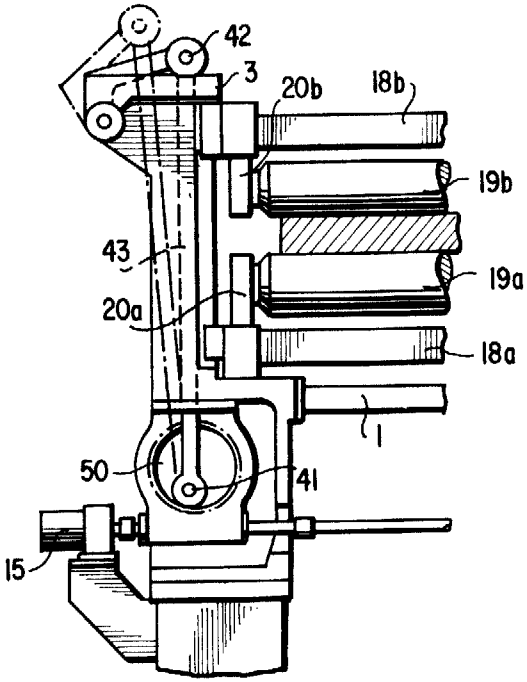
FIGS. 4, 5 and 6 are front views, partly in cross-section of other embodiments of the present invention.
Figure 4:
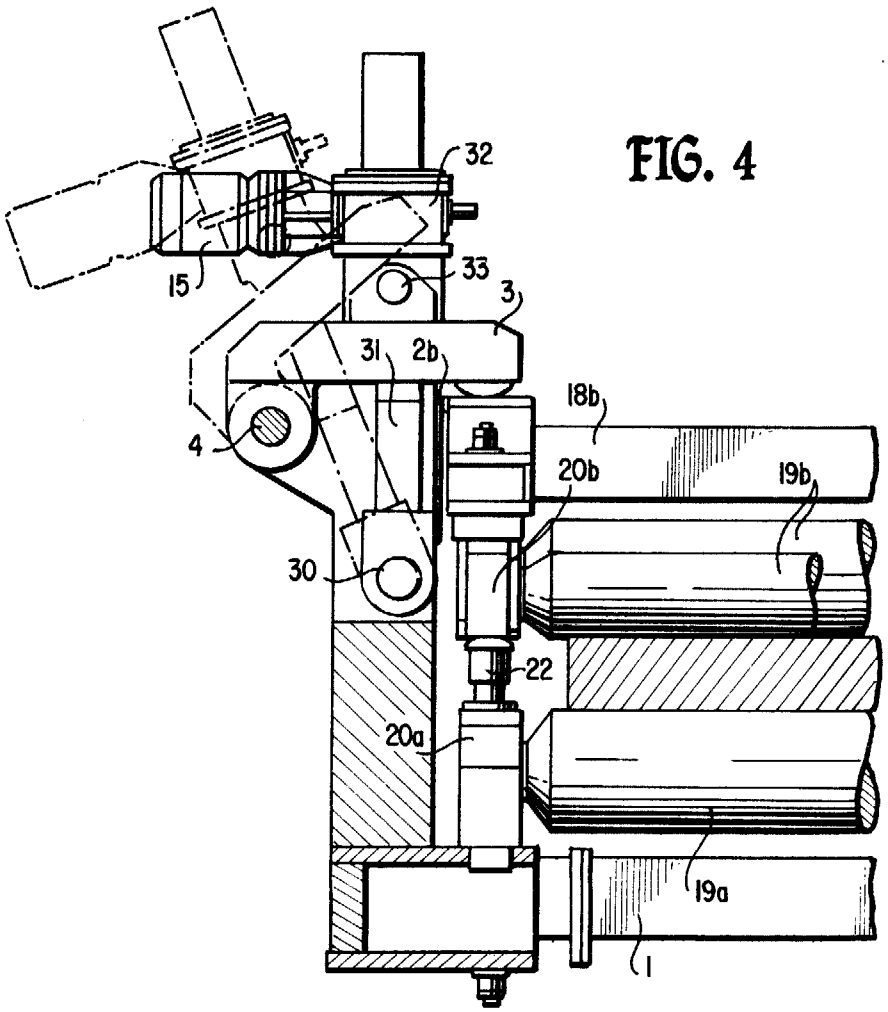
Figure 3:
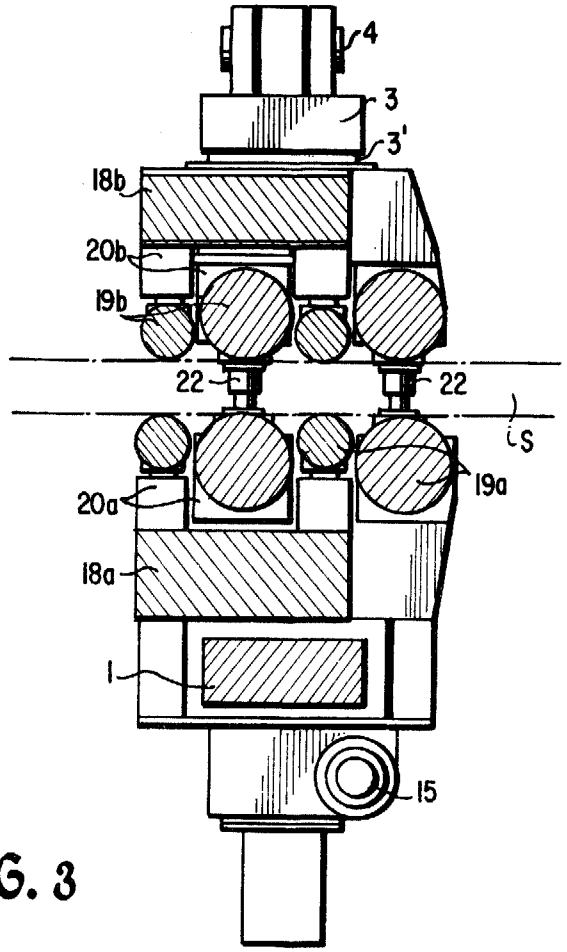
FIG. 3 is a side view, partly in cross-section of FIG. 1.
Figure 5:
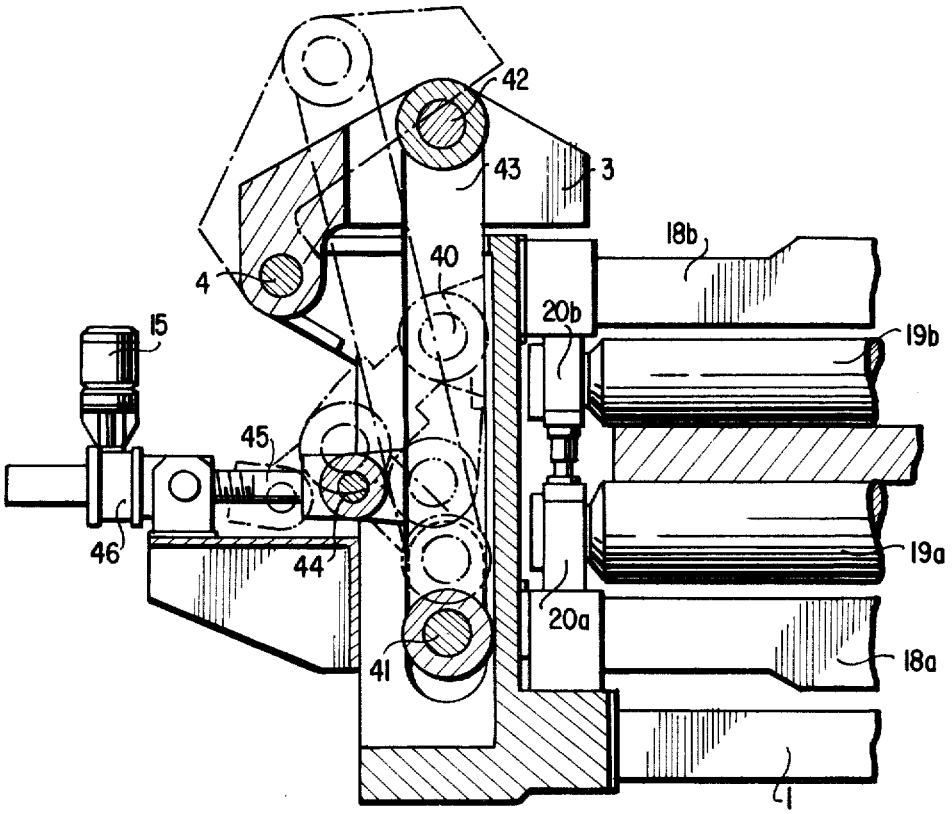

FIGS. 4 to 6 show other embodiments of the present invention wherein the parts corresponding to those in the construction shown in FIGS. 1 to 3 are indicated by the same reference characters. The embodiments shown in FIGs. 4 to 6 are alternative forms of the drive mechanism for driving the pivotable caps 3, and there is no difference from the embodiment of FIGS. 1 to 3 in the fact that the roll units 18*a*, 18*b* are secured in the frame 1 by means of the caps. The drive mechanisms of FIGS. 4 to 6 will now be described. FIG. 4 shows a drive mechanism wherein the frame 1 is provided with a screw shaft 31 pivotable about a pin 30, and an electric motor 15 is attached through a worm reduction gear 32 to the screw shaft 31. The reduction gear 32 or the electric motor 15 and the cap 3 are connected by a pin 33. Thus, when the electric motor 15 is actuated, the cap 3 pivotally secured to the reduction gear 32 or the electric motor 15 opens and closes. This movement is accompanied with pivoting of the screw shaft 31 and movement of the reduction gear 32 and the electric motor 15 along the screw shaft 31.

FIG. 5 shows a drive mechanism comprising a pin 40 secured to the frame, a pin 41 vertically slidable in the frame, a connecting rod 43 connecting the pin 41 and a pin 42 of the cap 3, a link for changing the interval of the pin 41 and the pin 40 by horizontal movement of a pin 44, a screw shaft 45 forcing the pin 44 in the horizontal direction, and an electric motor 15 and worm reduction gear 46 for driving the screw shaft 45. Thus, actuation of the electric motor 15 causes the pin 41 to be moved vertically in the frame 1, and the cap to be pivoted for opening and closing thereof.

FIG. 6 shows a drive mechanism comprising a rotary disc 50 rotated by an electric motor 15, an eccentric pin 41 attached to the rotary disc, and a connecting rod 43 for connecting a pin 42 of the cap 3 and the pin 41. Thus, rotation of the electric motor 15 is converted through the rotary disc 50 and the connecting rod 43 to the pivoting of the cap 3, and the cap 3 is opened and closed for outgoing and incoming of the roll units 18*a*, 18*b* and changing of the interval of the rolls 19*a* and 19*b*.

As described above with reference to the embodiments, in the cast piece guide roll segment according to the present invention, roll units including rotatably mounted rolls are inserted in a frame having an upwardly opening aperture, and said roll units are secured by caps pivotably provided on said frame. With this arrangement, it is only necessary to replace the roll units upon replacement of the rolls, since the roll units are lighter than the conventional cast piece guide roll segment, such that the replacement can be rapidly made as well as easily performed, the shut-down time of the continuous casting equipment is minimized and high productivity can be maintained. The rolls can be protected from undue stress due to contraction and curving of the cast piece in the cooling process if rupture is generated.

Furthermore, since the drive mechanism converts the rotational force to a linear force by means of a screw shaft before transmitting it to the cap, the great force exerted by the rolls on the cap cannot be transmitted to the drive source, such as the electric motor supported directly by the frame. Furthermore, if the caps are in the range of the operative position at which the roll units are pressed thereagainst, the force from the rolls will be positively transmitted to the frame at any operative position.

Obviously, many modifications and variations are possible in light of the above teachings. It is to be understood therefore that within the scope of the appended claims, the invention may be practiced otherwise than as specifically described herein.

We claim:

1. A cast piece guid roll segment in continuous casting equipment comprising:

roll units rotatably supporting at least a pair of rolls with the interval between opposing rolls being variable;

a frame having an aperture defined on the top thereof for removal and insertion of said roll units;

caps pivotably mounted on said frame and movable between a first position, at which said aperture is entirely uncovered and opened so as to permit said removal and insertion of said roll units through said aperture, and a second position, at which said aperture is covered so as to prevent the removal of said roll units and to press said roll units downwardly through said aperture, and through intermediate positions for varying said interval between said opposing rolls; and a cap drive mechanism for pivotal movement of said caps, and capable of being held by a force sufficient to hold the rolls at any position corresponding to the pivoting position of said caps.

2. A cast piece guide roll segment according to claim 1, wherein the cap drive mechanism includes a screw shaft in the frame, said screw shaft having a threaded portion and being connected to said cap and being vertically slidable.

3. A cast piece guide roll segment according to claim 1, wherein the cap drive mechanism includes a screw shaft pivotably connected to the frame and having a threaded portion and an electric motor for vertically moving said screw shaft.

4. A cast piece guide roll segment according to claim 1, wherein the cap drive mechanism includes a horizontally movable screw shaft and a link mechanism.

* * * * *